United States Patent [19]

MacDonald et al.

[11] 4,009,918

[45] Mar. 1, 1977

[54] HEIGHT ADJUSTABLE CABINET

[76] Inventors: Kenneth A. MacDonald, 251 York St., Canton, Mass. 02021; Edward J. MacDonald, 180 Border St., Scituate, Mass. 02066

[22] Filed: Jan. 22, 1976

[21] Appl. No.: 651,342

[52] U.S. Cl. ..... 312/255; 248/188.2; 248/188.4; 312/257 A

[51] Int. Cl.[2] ..... A47B 43/00; A47B 48/00; F16M 11/24

[58] Field of Search ..... 312/255, 253, 194 X; 248/188, 188.8, 221

[56] References Cited

UNITED STATES PATENTS

| | | | |
|---|---|---|---|
| 44,438 | 9/1864 | McBride et al. | 248/421 |
| 1,394,338 | 10/1921 | Nyman et al. | 248/188.2 |
| 1,435,606 | 11/1922 | Henry | 248/188.4 |
| 1,632,383 | 6/1927 | Seiden | 248/188.4 |
| 2,179,307 | 11/1939 | Sywert | 312/257 A |
| 2,524,819 | 10/1950 | McKeon | 248/188.2 |
| 2,544,822 | 3/1951 | Brown | 248/188.4 |
| 2,545,949 | 3/1951 | Fox | 248/188.2 |
| 3,378,223 | 4/1968 | Way et al. | 248/188.2 |
| 3,883,196 | 5/1975 | Mohr et al. | 312/257 A |

FOREIGN PATENTS OR APPLICATIONS

| | | | |
|---|---|---|---|
| 502,865 | 2/1920 | France | 248/188.2 |

*Primary Examiner*—Paul R. Gilliam
*Assistant Examiner*—V. Sakran
*Attorney, Agent, or Firm*—Morse, Altman, Oates & Bello

[57] ABSTRACT

Panel legs are provided to support one or more connected cabinets in a row and to raise and lower the cabinet to a pre-selected height. Each leg is relatively thin and is comprised of a fixed, lower frame adapted to rest on the floor and a moveable upper portion connected to the cabinet. The moveable upper portion is raised and lowered with respect to the fixed lower portion by means of a lever pivoted at one end to the fixed frame and at the other end adapted to be set into any one of a number of vertically spaced notches formed in a fixed vertical post forming part of the fixed leg section. The lever connects to the moveable upper portion of the leg and, by operation of the lever, the upper portion of the leg, together with any cabinets attached thereto, will be raised or lowered to a selected height. The working mechanism is contained within the leg and is normally hidden from view by means of a removable front panel. A reversible connecting plate is attached to the rear part of the fixed frame portion, extending through the rear of the moveable portion for attachment to the wall behind the cabinets.

8 Claims, 11 Drawing Figures

HEIGHT ADJUSTABLE CABINET

BACKGROUND OF THE INVENTION

1. Field of the Invention

This invention relates generally to cabinets and more particularly is directed toward a new, improved panel leg assembly adapted to raise and lower the height of cabinets attached thereto.

2. Description of the Prior Art

Conventional kitchen cabinets are installed on a permanent basis and normally are of fixed height in which a unitary cabinet base is provided with a counter top and may include a sink, a range, and other equipment. The height of the counter top usually is determined according to industry standards in order to most conveniently accommodate the average person. While the standard base cabinets and counters are convenient for an average, ambulatory person, access is difficult for one who is confined to a wheelchair. For those that must move about in wheelchairs, the height of the counter in a kitchen is of considerable concern since the counter top very frequently will be too high for an average size person to reach from a sitting position. Further, it has been found that the most convenient working height for a counter top will vary from one wheelchair confinee to another, so that the provision of a fixed, low-level counter would not resolve the problem if the cabinets are to be used by several different persons all confined to wheelchairs.

Accordingly, it is an object of the present invention to provide means for conveniently adjusting the height of cabinets, especially kitchen cabinets. A more specific object of this invention is to provide a modular panel leg that may be attached to the ends of a row of cabinets, which leg is attached to the cabinet and permits the cabinets to be raised and lowered within a range of heights.

SUMMARY OF THE INVENTION

This invention features a modular panel leg adapted to be attached, one at each end, to one or more cabinets, each leg including a fixed, lower portion adapted to rest on the floor and a moveable upper portion telescopically engaging the lower portion and adapted to be connected to the cabinets. In the preferred form of the invention, a lever connects to the fixed portion and has a free end adapted to lock into one of several notches, the lever being connected by means of a link to the upper portion. By moving the lever up or down, the cabinet section may be raised or lowered, as desired. The fixed portion may be secured permanently to the wall behind the cabinets in order to legs the lega and the assembled cabinets.

DETAILED DESCRIPTION OF THE PREFERRED EMBODIMENTS

Figure 1:
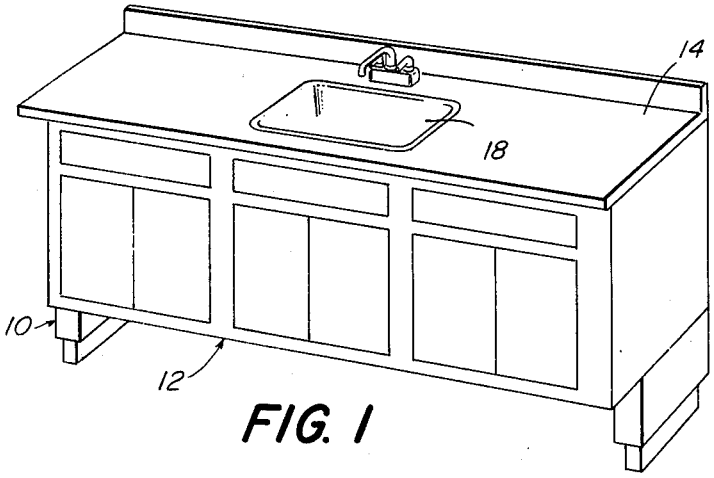
FIG. 1 is a view in perspective of a group of cabinets supported between a pair of modular panel legs made according to the invention.

Referring now to the drawings, the reference character 10 generally indicates an adjustable panel leg normally provided in pairs, one at each end of a group of cabinets 12. In practice, several cabinets may be attached to one another by bolting, and all of the cabinets being suspended from a counter top 14, extending along the full length of the set of cabinets. Where a relatively long group of cabinets is to be installed, a suitable brace 16 may be provided. The brace typically may be in the form of one or more lengths of angle iron extending underneath the group of cabinets and attached to each of the panel legs 10 as suggested in FIG. 9. The group of cabinets 12 may include typical kitchen equipment, such as a sink 18 or the like, and which, in practice, may be connected to piping by means of flexible conduits, telescopic drainpipes and the like, so that the entire unit may be raised or lowered with a minimum of effort.

Figure 9:
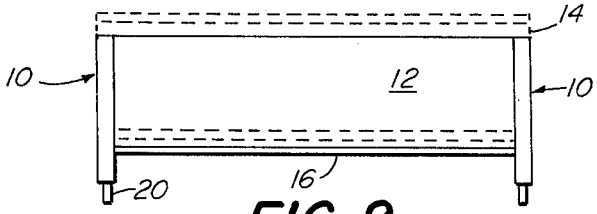
FIG. 9 is a view in front elevation showing a group of cabinets at different working heights.

Each leg 10 is relatively thin, being on the order of perhaps 3 inches thickness and having a depth corresponding to that of the cabinets attached thereto. In general, the legs are more or less coextensive with the ends of the cabinets and follow the profile of the cabinets, except the lower portion which extends down below the bottom of the cabinets so that the space under the section of cabinets 12 is free and clear, as best shown in FIG. 1 and 9.

Each leg is comprised of two main sections, namely, a fixed lower section 20 and a moveable upper section 22 telescopically mounted over the lower section. The upper section 22 is generally in the form of a hollow housing profiled to match the end of the cabinets and attached thereto by suitable fastening means, such as screws or the like. The upper section includes parallel side walls 24 and 26, spaced from one another by means of a top core member 28 extending from front to back of the housing, a rear wall 30, a forward guide wall 32, and a cross piece 34. The forward guide wall 32 extends vertically and is spaced in parallel relation to the back wall 30, while the cross piece 34 extends horizontally forward from the wall 32, terminating directly below the upper, forward edge of the core member 28. The front of the leg is provided with a detachable panel 36 which typically is finished to match the cabinets 12. The panel 36 is removable in order to allow access to the lifting mechanism within the leg, and, in the illustrated embodiment, it is connected by means of an L-shaped connector 38 adapted to lock against a shoulder 40 formed at the forward, lower side of the core 28. A pad eye 42 is provided at the lower edge and inner face of the removable panel, and is adapted to be secured by means of a screw driven up through the bottom of the cross piece 34. The back wall 30 is formed with a slot opening 44 for reasons that will presently appear.

Figure 4:
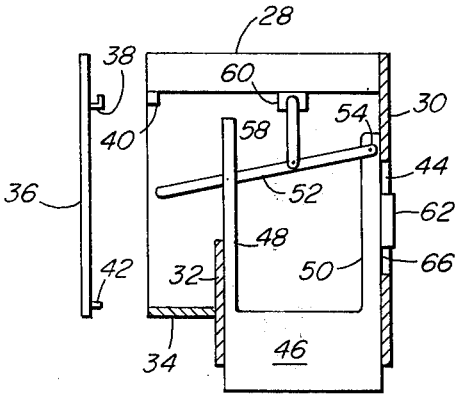
FIG. 4 is a sectional side elevation of the panel leg.
Figure 5:
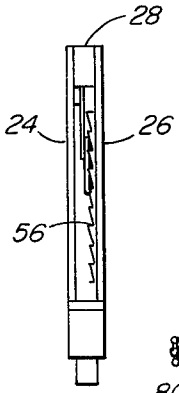
FIG. 5 is a view in front elevation with the front access panel removed.

The lower leg section 20 includes a solid base portion 46, the lower edge of which rests on the floor. The base portion is between the walls 30 and 32 of the moveable upper housing and between the side walls 24 and 26, with a slight clearance sufficient to allow free movement between the upper and lower portions of the panel leg. Extending upwardly from the base portion 46 are parallel extensions 48 and 50, with the extension 48 extending vertically upward from the front edge of the base portion 46 and adjacent to the housing wall 32, while the rear extension 50 extends vertically upward adjacent the back wall 30 of the housing. The extensions are generally of corresponding height and serve to accommodate the hoisting mechanism which includes a lever 52 pivoted by means of a pin extending through the extension 50 and the inner end of the lever. The forward end of the lever 52 is adapted to seat in any one of a number of notches 56 formed along the side face of the extension 48, as best shown in FIG. 5. A link 58 pivotally connects the medial portion of the lever 52 to a pad 60 attached to the underside of the core 28, as best shown in FIG. 4. It will thus be understood that the upper, moveable housing 22 of the panel leg may be raised or lowered by merely removing the front panel 36, gripping the outer end of the lever 52, and then raising or lowering it into any selected notch 56. Insofar as the cabinets are attached to the moveable housing section, the cabinets will move as a unit to the new height position.

In order to stabilize the legs as well as the cabinets, without interfering with the adjustability of the legs, the fixed lower portion 20 is secured to the kitchen wall behind the section of cabinets.

Figure 7:
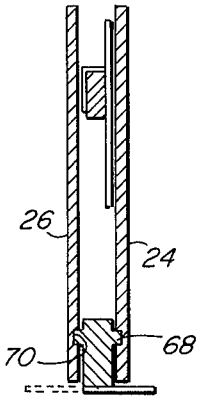
FIG. 7 is a cross-sectional view taken along the line 7—7 of FIG. 6.
Figure 6:
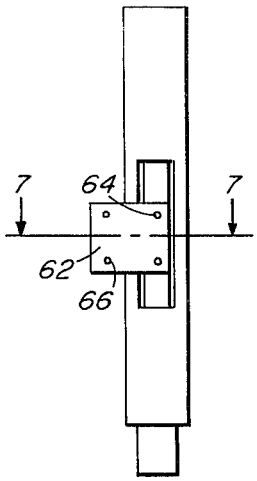
FIG. 6 is a view in rear elevation.

In the embodiments of FIGS. 6 and 7, the fixed leg portion 20 is secured to the wall behind the cabinets by means of a plate 62 which is detachably connected to the rear edge of the fixed extension 50. The plate is attached preferably by means of screws 64 passing through openings formed in the plate and driven into a boss 66 formed on the rear edge of the extension 50 and extending through the opening 44, terminating in a plane substantially even with the back surface of the rear wall 30. The plate is preferably rectangular and, when mounted, extends to one side or the other of the leg, as shown in FIGS. 6 and 7. The outer extension portion of the plate is formed with holes 66 adapted to receive screws driven into the wall behind the cabinets. In this fashion the leg panels may be securely fastened to the wall and provide a very sturdy, stable assemblage of cabinets. Insofar as the position of the plate 62 may be reversed to extend to either side of the leg, the plate may always be hidden from view and the legs are made interchangeable since they are attachable to either end of the cabinets. In practice, the portion of the plate attached to the wall will be behind the cabinets and out of sight.

In the FIGS. 6 and 7 embodiments, further stability is provided between the fixed part of the leg 20 and the moveable part 22 by means of cooperating tongues 68 formed vertically in the extension 50 and mating grooves 70 formed in the inner faces of the walls 24 and 26. It will be understood that the configuration provides a sliding fit to ensure smooth movement between the leg parts when the lever is being operated, eliminating play and looseness in the assemblage.

Figure 8:
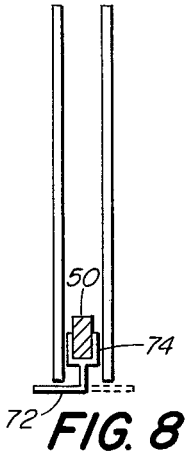
FIG. 8 is a view similar to FIG. 7 but showing a modification of the wall connection.
Figure 2:
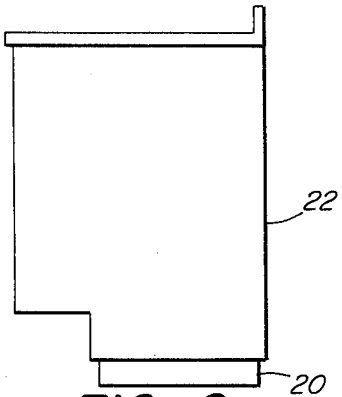
FIG. 2 is a view in end elevation thereof.
Figure 3:
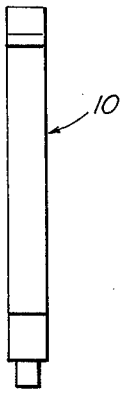
FIG. 3 is a view in front elevation of a panel leg made according to the invention.

In FIG. 8 there is an illustrated modification of the wall connecting arrangement and, in this embodiment, an L-shaped bracket 72 is detachably connected to an extension 50', corresponding to the extension 50 of the principal embodiment. The bracket 72 may be in one or two pieces, and in either event terminates in a U-shaped portion 74 secured to the extension 50' and extending through the opening in the back wall of the leg housing, as before. As shown in dotted line in FIG. 8, the bracket may be disconnected and reversed from one side to the other, depending upon the position of the panel leg with respect to the cabinets supported thereby.

Figure 10:
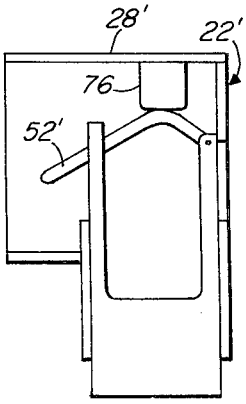

Referring now to FIG. 10, there is illustrated another modification of the invention, and, in this embodiment, a lever 52' directly engages the top of the moveable leg section by means of a block 76 bearing against a contoured lever 52'. As shown in FIG. 10, the lever 52' is bent into a cam configuration at the area of engagement with the lower face of the block 76, so that as the lever 52' is moved up or down, the leg section 22' will also move up or down with it.

Figure 11:
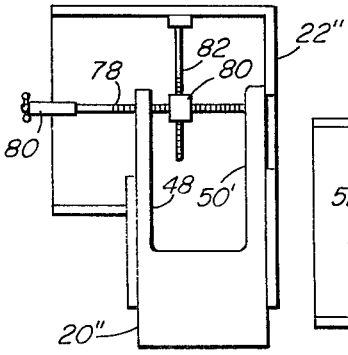
FIGS. 10 and 11 are views similar to FIG. 4 but showing modifications of the invention.

In FIG. 11 there is illustrated a further modification of the invention, and in this embodiment the lever mechanism is replaced by means of a screw jacking mechanism comprised of a horizontal lead screw 78 rotated by means of a detachable crank 80 at the outer end thereof and rotatable through bearings provided in the upper ends of the extensions 48' and 50'. The lead screw 78, in turn, causes rotation of a follower 80 engaging a vertical jack screw 82, the upper end of which engages the leg section 22''. It will be understood that by rotating the crank 80 either in one direction or the other, the height of the leg may be adjusted.

Having thus described the invention, what we claim and desire to obtain by Letters Patent of the United States is:

1. A height adjustable leg for use with cabinets or the like, comprising a. a thin, flat and relatively fixed section having a floor-engaging lower edge adapted to be supported upright by a fixed horizontal surface, b. a thin, flat relatively movable hollow housing section telescopically and vertically connected to said fixed section, c. said movable section adapted to be connected to said cabinets, d. movable mechanical advantage means operatively connected between said fixed and movable sections for selectively raising and lowering said movable section with respect to said fixed section, e. said movable section generally corresponding in profile with the end walls of said cabinet and being substantially coextensive therewith, f. the upper edge of said movable section being substantially level with the top of said cabinets, and, g. connecting means at the rear portion of said leg for fastening said leg to a fixed vertical wall.

2. A leg, according to claim 1, wherein mechanical advantage means includes a lever, one portion thereof being pivotally connected at its rear end to a rear portion of said fixed section and having a medial section engaging said movable section and locking means engageable with said lever for locking said lever at a selected position, the forward end of said lever extending towards and accessible from the forward edge of said leg.

3. A leg for use at the end of a floor-mounted cabinet or the like, comprising a. a flat, narrow, hollow housing generally coextensive with and conforming in outline to a side wall of said cabinet and adapted to be connected thereto, b. said housing being formed with openings in the bottom and front walls thereof, c. a relatively fixed member extending through said bottom opening and having a lower edge adapted to bear against the floor, d. said housing being formed with a guideway slidably engaging said fixed member, e. said fixed member being formed with front and rear vertical extensions, said front vertical extension being formed with vertically spaced teeth, f. a lever pivoted at one end to said rear extension and adapted at its other end to engage and lock to one of said teeth in said front extension, g. said lever engaging said housing whereby said housing is raised and lowered by movement of said lever, and, h. height-accommodating connecting means at the rear of said leg for connecting said leg to a fixed vertical wall.

4. A leg, according to claim 3, including a link connected between a top wall of said housing and a mid portion of said lever.

5. A leg, according to claim 3, including a removable panel mounted in said front opening.

6. A leg, according to claim 3, wherein said connecting means includes a vertical slot opening formed in the back wall of said housing and wall fastening means connected to said rear extension and extending through said opening for fastening said leg to a fixed wall.

7. A leg, according to claim 6, wherein said fastening means include a flat plate extending parallel to said back wall and projecting to one side of said leg.

8. A leg, according to claim 7, wherein said plate is reversibly connected to said rear extension whereby said plate may project to either side of said leg.

* * * * *